US008272240B1

(12) United States Patent
Schilens

(10) Patent No.: US 8,272,240 B1
(45) Date of Patent: Sep. 25, 2012

(54) REMOTE CONTROL MARINE LOCK SYSTEM

(76) Inventor: James A. Schilens, Avon Lake, OH (US)

( * ) Notice: Subject to any disclaimer, the term of this patent is extended or adjusted under 35 U.S.C. 154(b) by 1726 days.

(21) Appl. No.: 11/548,358

(22) Filed: Oct. 11, 2006

(51) Int. Cl.
*E05B 13/10* (2006.01)

(52) U.S. Cl. ..... 70/208; 70/210; 70/224; 70/278.1; 292/336.3

(58) Field of Classification Search ..... 70/208–211, 70/224, 278.1; 292/207, 336.3
See application file for complete search history.

(56) References Cited

U.S. PATENT DOCUMENTS

| | | | | |
|---|---|---|---|---|
| 5,526,660 | A * | 6/1996 | Bennett et al. | 70/208 |
| 5,791,179 | A * | 8/1998 | Brask | 70/280 |
| 5,913,908 | A * | 6/1999 | Czipri | 70/208 |
| 6,418,761 | B1 * | 7/2002 | Wytcherley et al. | 70/208 |
| 6,530,250 | B1 * | 3/2003 | Linares et al. | 70/208 |
| 6,532,778 | B2 * | 3/2003 | Molzer et al. | 70/208 |
| 6,585,302 | B2 * | 7/2003 | Lin | 70/280 |
| 6,976,375 | B2 * | 12/2005 | Minix | 70/208 |
| 7,066,504 | B2 * | 6/2006 | Perkins | 70/208 |
| 7,454,933 | B1 * | 11/2008 | Paige et al. | 70/208 |
| 7,647,797 | B1 * | 1/2010 | Viso Cabrera et al. | 70/208 |
| 7,695,031 | B2 * | 4/2010 | Jackson et al. | 70/208 |

* cited by examiner

*Primary Examiner* — Christopher Boswell
(74) *Attorney, Agent, or Firm* — Pearne & Gordon LLP

(57) ABSTRACT

A system for simplifying launching and storage procedures for a recreational boat comprising a radio receiver/controller adapted to be permanently installed onboard the boat, a hand-held radio transmitter for sending a plurality of different signals to the receiver/controller, the receiver/controller including a plurality of separate control circuits, said circuits being connectable to a plurality of power-operated locks on the boat and a set of other electrically operated devices on the boat such as electric lights, an engine tilt actuator, and a bilge blower, the receiver/controller being arranged to be powered by an electrical power circuit serving electrically operated devices on the boat separate from those controlled by the transmitter and receiver/controller, the locks being integrated with manually operated latches and having a manual key override feature.

11 Claims, 5 Drawing Sheets

FIG. 1
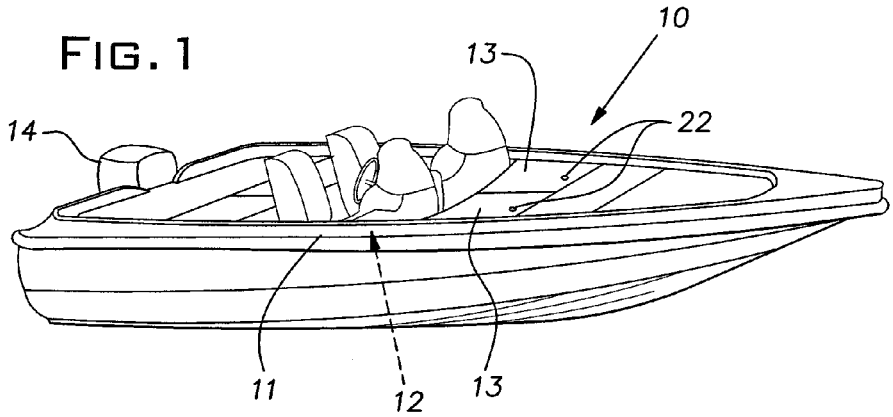
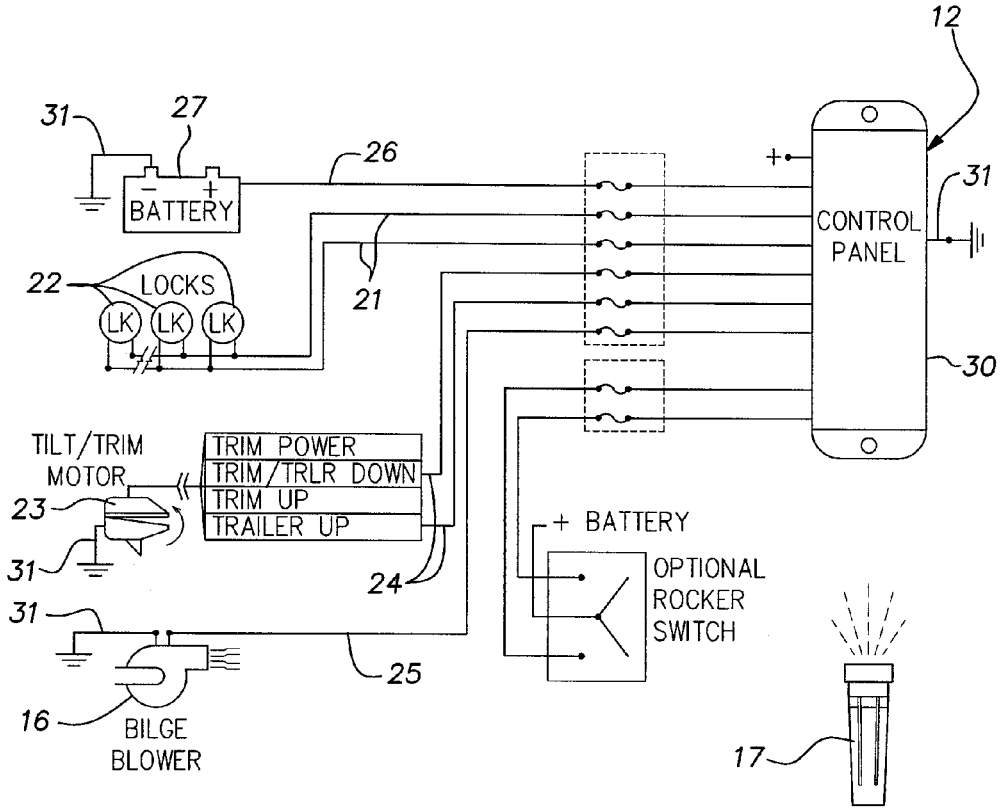
FIG. 2

FIG. 3
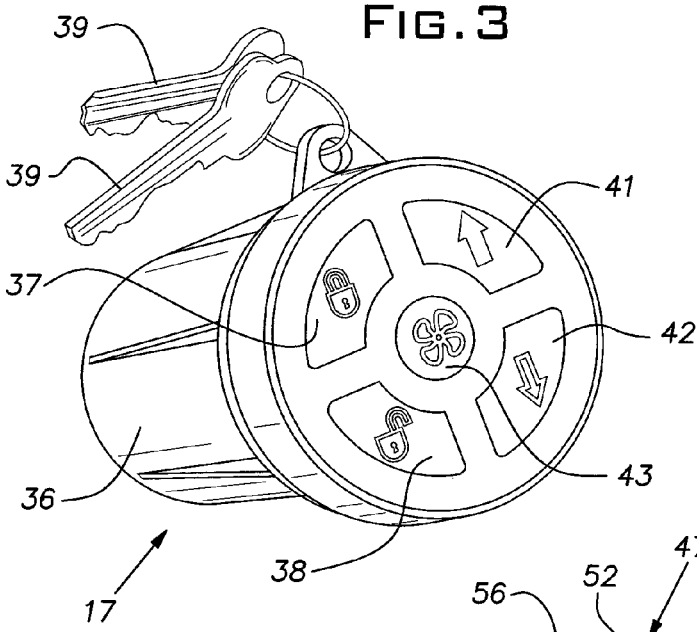
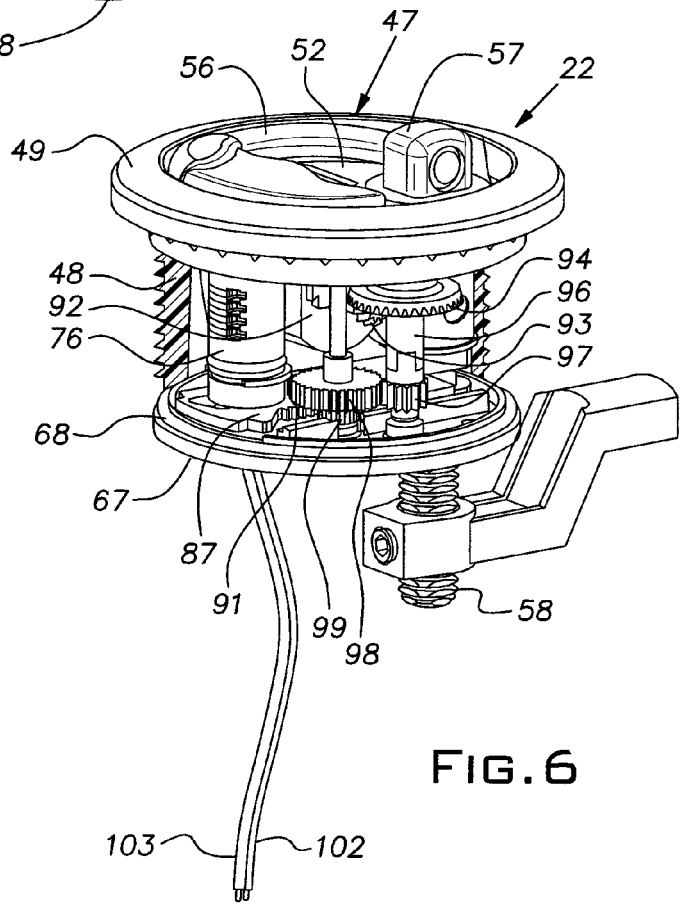
FIG. 6

LATCH LOCKED, KEY LOCKED

LATCH UNLOCKED, KEY UNLOCKED

LATCH LOCKED, KEY NEUTRAL

LATCH UNLOCKED, KEY NEUTRAL

REMOTE CONTROL MARINE LOCK SYSTEM

The invention relates to remote control of electrically operated devices in marine applications and, in particular, for pleasure and sport boats.

PRIOR ART

Leisure time spent on a pleasure or recreational boat can be simplified and made more secure and, therefore, more enjoyable, where basic chores and routines can be accomplished remotely, for example, by the push of a button. Certain precautions or necessary actions should or must be performed in preparing a boat for use or for a period of dockage or storage. For example, it is desirable to lock the various hatches and doors on a boat when it is to be left unattended. Similarly, in preparation for use it is desirable to unlock all of these hatches and doors with a minimum of effort and time. Other functions that can be convenient to initiate remotely are operating the bilge fan, trim motor, and/or lights.

While the goal of providing remote power locking and unlocking, once conceived, is desirable, its practical realization is difficult for various reasons. Preferably, a power lock mechanism must be self-contained and, ideally, should comprise a relatively small package so that it is unobtrusive and, ideally, it should be integrated with a catch that can be both manually operated and manually locked.

These functions should be integrated into a small package size that is not substantially larger than the size of manually operated latches. Further, the package size and shape should be of a nature that can be accepted in a simple round hole cut in a hatch, door or other panel and should be capable of use with hatches, doors and panels of different thickness.

SUMMARY OF THE INVENTION

The invention provides a remote control system especially suited for pleasure boats and like marine applications that reduces time and effort spent in locking or unlocking a plurality of latches as well as performing other control functions such as bilge air exhaust, engine tilt, and lighting control. In accordance with the invention, remote control of the various functions is performed by a single radio control receiver unit. This single unit offers convenience to the user, reduces manufacturing costs and saves installation time and required skill. The system offers a remotely controlled power locked latch for hatches, doors and like closures. The remotely lockable latch is constructed in a manner that enables it to be contained within a small housing that fits within a correspondingly small circular hole. A mechanism within the latch housing includes a latch locking element or bolt that is operable by a remotely controlled electrical actuator within the housing or manually with a key operating a lock set also contained in the housing. The electrical actuator and the lock set are arranged to enable the lock set to override the actuator in the case of a power loss. A high locking force is developed by the actuator, despite its small physical size, with a novel gear train connecting the actuator to the locking bolt. The drive train, moreover, is arranged to permit the manual override function to be achieved in a simple, reliable manner.

The invention simplifies routines involved in launching and docking recreational boats. The invention contemplates remote control of multiple locks as well as electrically operated devices by a simple hand-carried wireless transmitter and a simple single radio receiver mounted within the hull. The transmitter/receiver combination is capable of operating several devices independently thereby achieving economies of manufacture and installation as well as a high level of convenience to the user.

BRIEF DESCRIPTION OF THE DRAWINGS

FIG. 1 is a stylized perspective view of merely but one example of a recreational boat with which the invention can be employed;

FIG. 2 is a schematic electrical diagram illustrating certain aspects of the invention;

FIG. 3 is a perspective view of a hand-held signal transmitter for use with the invention;

FIG. 6 is a fragmentary perspective view of the lockable latch showing internal parts thereof;

DESCRIPTION OF THE PREFERRED EMBODIMENT

Figure 4:
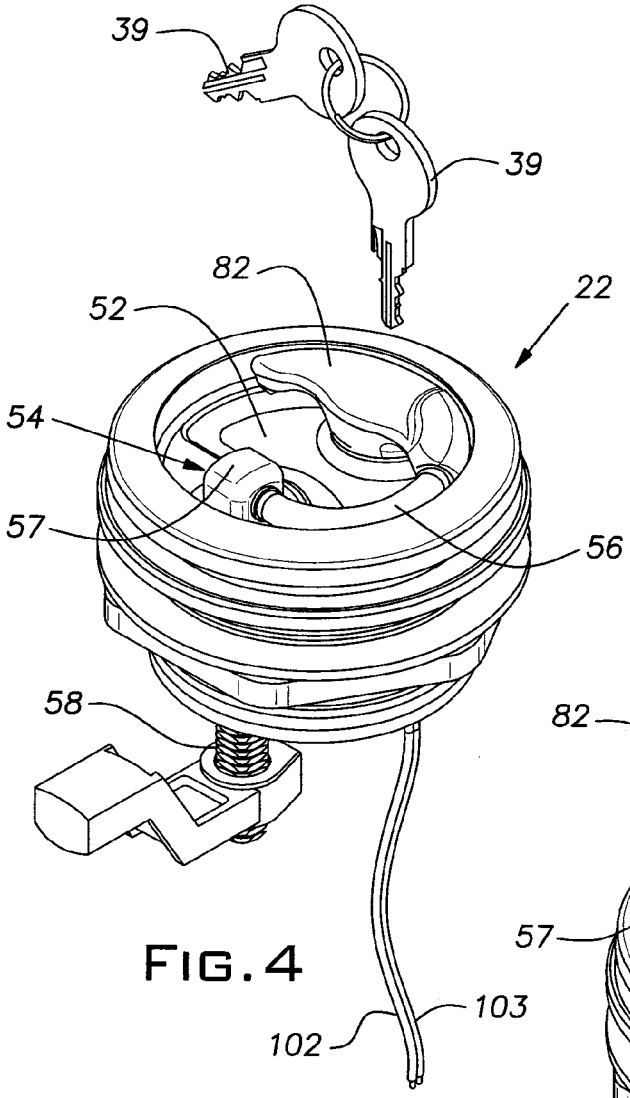
FIG. 4 is a perspective view of a self-contained remotely operable lockable latch in accordance with the invention.

FIG. 1 schematically represents a pleasure, sport, or other recreational boat 10 with which the invention may be employed. The boat 10 has a helm 11 at or adjacent which a radio receiver and control unit 12 is installed, ordinarily in a permanent manner. The boat 10 also typically has hatches 13, outboard motor 14 and a bilge blower 16 (FIG. 2). The receiver/control unit 12 is remotely operated by a hand-held radio transmitter 17 schematically shown at the lower right in FIG. 2 and in perspective in FIG. 3.

FIG. 2 illustrates a typical wiring diagram that reflects electrical connections between the receiver/control unit 12 and various electrically operated devices. More specifically, the receiver/control unit 12 has a plurality of output circuits connected by electrical lines 21 to power locked latches 22 (described in detail below), by lines 24 to tilt/trim actuator(s) 23 for the outboard motor 14 and by a line 25 to the bilge blower 16. A line 26 connects the positive terminal of a conventional lead acid storage battery 27, normally the battery that operates the electrical system of the boat to the receiver/controller 12. Ground wires 31 are common with the negative terminal of the battery 27. The electronic components of the receiver/controller 12 are potted in a waterproof housing 30 with a suitable material such as epoxy.

By energizing appropriate lines with DC power from the battery 27, the receiver/controller 12 can operate locks of the latches 22, motor tilt/trim actuator 23, and/or the bilge blower 16. Other electrically operated devices such as electric lights can be substituted for one or more of the mentioned remotely controlled devices by appropriately connecting the lines 24, 25. Similarly, auxiliary electrically operated devices can be connected in parallel with any of these devices where multiple simultaneous functions are desired.

With reference to FIG. 3, the transmitter 17 is preferably a small hand-held device that in the illustrated case is generally cylindrical in shape and can simulate the look of a buoy. At one end of a case or housing 36 of the transmitter 17 are five waterproof push buttons. Ideally, the volume of the housing 36 compared to the weight of the transmitter is such that the transmitter will float even when weighed down by a set of two keys of ordinary weight, or more, usable with the latch lock described below. Two buttons 41, 42 control the tilt up or down action of the tilt actuator 23 and one button 43 controls the bilge blower 16. In the illustrated arrangement, the controller 12 can be arranged with the transmitter 17 so that the lock and unlock buttons 37, 38 and bilge blower button 43 can be of the momentary contact-type operation while the tilt buttons 41, 42 are effective only while being depressed. Keys 39 of ordinary size for locking the latches 22 are shown in FIG. 3 to give an indication of scale or size of the transmitter 17. The transmitter housing 36 contains a battery for its power and operates like the remote locks commonly used with automobiles. The transmitter 17 sends encoded signals corresponding to the button selected to the receiver/controller 12. The receiver/controller 12 powered by the battery of the boat's electrical system responds to the signals received from the transmitter and energizes the appropriate line or lines 21, 24, 25, and/or 26.

FIGS. 4-11 illustrate a lockable latch 22 in greater detail. The latch 22, typically in multiple sets, can be fitted on the hatches, doors or like panels 13 of the boat 10. Preferably, the latch 22 has a circular housing 47 molded of a suitable rigid plastic such as polycarbonate. The housing 47 has an externally threaded cylindrical wall or skirt 48 and a somewhat larger peripheral mounting flange 49 at its front face. A molded plastic internally threaded nut 51 mates with the threads of the housing skirt 48. The front face of the housing 47 has a recessed end wall 52 generally perpendicular to the axis of the side wall or skirt 48 and integral with the sidewall. The sidewall 48 and end wall 52 have limited thickness so as to form and enclose a hollow housing interior. The end wall 52 has a first aperture 53 through which a handle stem 54 extends. A handle 56 pivots in a cross bore formed in an outer plastic part of the stem 54 which is permanently molded onto an inner metal part 58 of the stem. The metal stem part 58, preferably formed of stainless steel, has a generally square cross-section with its corners externally threaded to accept a cam or latch bar 59 threaded onto it and retained in position by a set screw. The handle 56 is retained on the molded stem part 57 by C clips or other suitable elements. The molded stem part 57 has a stepped generally cylindrical body including a shank 61 that is supported in a bore 62 molded in an internal boss 63 in the housing 47. The stem 54 pivots in the bore 62 about an axis that is offset and parallel to a central axis of the housing 47. A spring loaded detent ball 64 carried in the molded stem part 57 indexes with recesses (not shown) in the bore 62 to accurately register the stem 54 in either the latching position shown, for example, in FIGS. 4-6, or in an unlatching position 180° from the illustrated position. An elastomeric O-ring 66 in a groove in the shank 61 seals against the bore 62 to exclude water from the interior of the housing 36.

The rear of the housing 47 is closed by a circular molded plastic cover 67 and retained in place by screws (not shown). A short skirt 68, integral with the cover 67 fits into the housing skirt 48 and is sealed with the housing by an O-ring 69 to exclude water from passing into the housing. An end of the molded stem part 57 projects through a hole 71 in the rear cover 67 and an O-ring 72 is assembled around the molded part to exclude water from entering the housing in this area.

On a side of the central axis of the housing 47 opposite the stem 54, i.e. in a diametral sense, is a cylindrical lock 76, sometimes referred to as a plug. A cap 77 of the plug 76 has a slot for receiving a key 39 for operating it. The plug 76 is received in a bore 78 of an internal boss 79 integrally molded in the housing 47. The plug 76 is sealed in the bore 78 by an O-ring to exclude water from entering the interior of the housing 47. A molded finger grip part 82 of the handle 56 has a circular seal 83 of elastomeric material retained on its underside by a screw 84. The seal 83 fits snugly into the plug receiving bore 78 to exclude water from the housing interior when the handle 56 is in a retracted or flush position on the housing as shown in FIGS. 4 and 6.

A portion 86 of the molded part of the stem 57 has a square cross-section that can be engaged or disengaged by the forked end of a flat locking bolt 87. The bolt 87, made of a suitable metal, has a trapezoidal hole 88 as shown in FIGS. 7-10 at an end opposite the forked end that receives an operating lug 89 of the lock or plug 76. The mid-section of one long edge of the bolt 87 is made with teeth that form a gear rack 91.

A miniature DC motor 92 within the housing 47 operates to drive the bolt 87 towards or away from the stem 54 depending on the direction it rotates. The motor or actuator 92 remains connected to the rack 91 by a gear train that, with reference to FIG. 6, originates at a bevel pinion 93 on the motor shaft and includes a bevel gear 94, a shaft 96, and spur gears 97, 98 and 99. The spur gear 99 meshes with the teeth of the bolt rack 91. It will be seen that the motor is situated between the stem 54 and plug 76 with its shaft in a plane perpendicular to the axis of the stem and plug. Three stages of gear reduction are produced by the pinion and bevel gear 93, 94, the spur gears 97, 98, and the spur gear 99 with the rack 91. The orientation and position of the motor 92 and the three stage, right angle gear reduction achieves a compact drive package while developing a relatively high force on the bolt 87 and enabling the drive and motor to be easily back driven as will be discussed below.

As indicated in FIG. 1, a plurality of latches 22 can be operated by the receiver control unit 12. The motors 92 have their electrical leads 102, connected in parallel to the lines 21. The direction that the motors 92 operate is dependent on the polarity of the voltage applied to the lines 21. When the lock button on the transmitter 37 is pushed, the receiver/control unit 12 applies DC voltage, typically 12 volts, to the lines 26. When the unlock button 38 is pushed, the opposite polarity is applied to the lines 26.

The latch 22 is easily installed on a panel 13 such as a hatch or door on the boat 10. By way of example, the cylindrical housing skirt can fit comfortably in a nominal 2½" hole conveniently cut, for example, with a hole saw or other similar tool. A gasket 101 can be assembled on the skirt 48 so that a water-resistant joint is formed between the face of the panel and the back side of the mounting flange 49. With the skirt 48 projecting through the panel, the nut 51 is threaded onto the skirt tightly enough to ensure the gasket 101 produces the desired water-tight fit. The length of the skirt 48 permits the latch 22 to be used with a large range of panel thicknesses. The adjustability of the cam or latch bar 59 on the threaded metal part of the stem 58 allows the cam to be properly fitted against the structure surrounding the panel 100 on which the latch 22 is installed.

Figure 5:
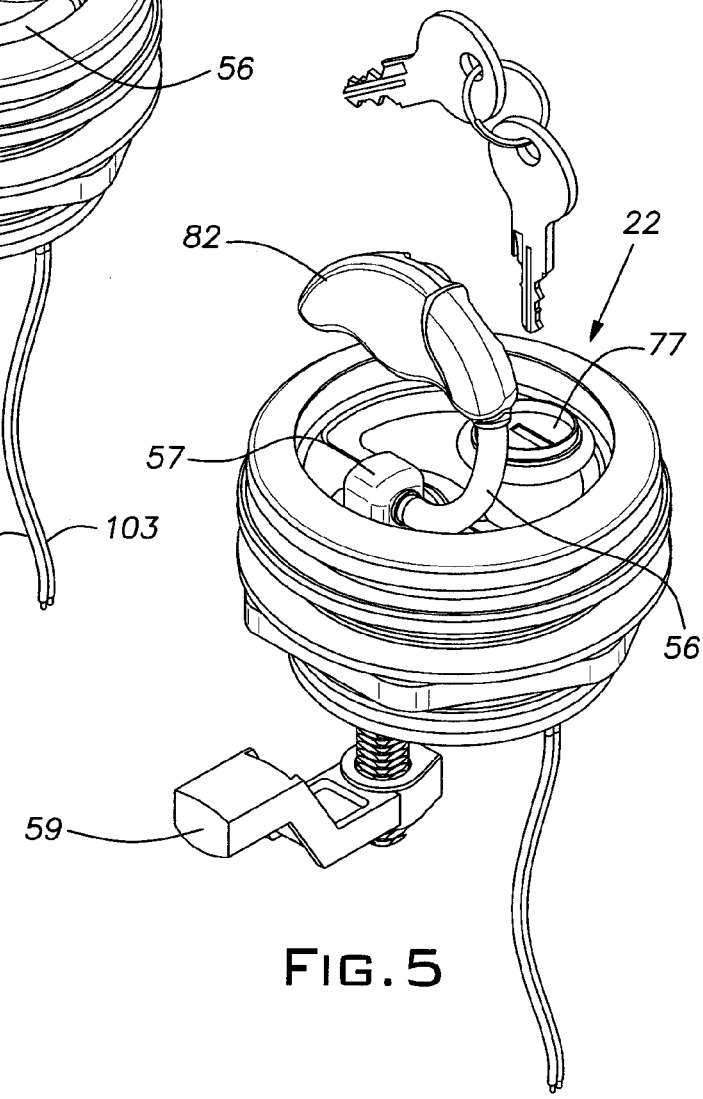
FIG. 5 is a view similar to FIG. 4 with a manual latch handle raised to an active position.
Figure 7:
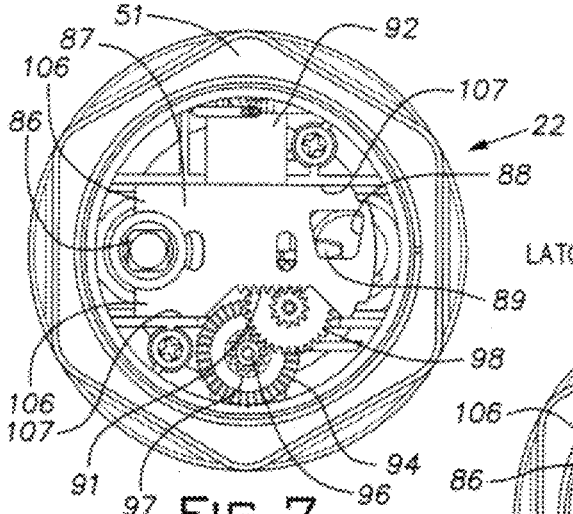
FIG. 7 is a bottom view of the lockable latch with its cover removed showing the latch locked and a key locked position.
Figure 9:
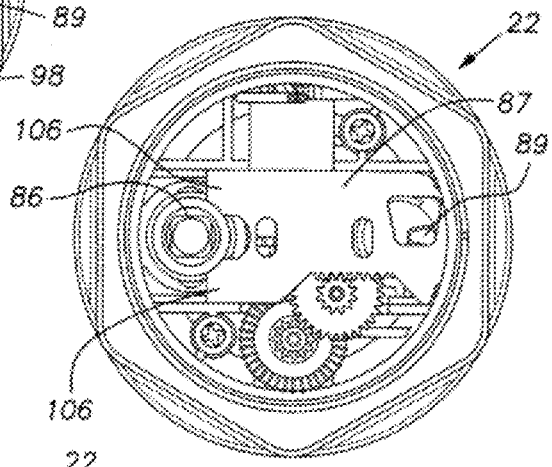
FIG. 9 is a view similar to FIG. 7 with the latch unlocked and a key unlocked position.

A latch 22 holds its associated hatch or panel closed when the cam or locking bar 59 is in the position of FIGS. 4 and 5. FIG. 5 shows the handle 56 lifted from the front flush position of FIG. 4 to enable a user to rotate the stem 54 180° to thereby swing the cam 59 under the latch housing 47 and thereby unlatch the hatch or panel 100. In this rotated stem position, the handle 56 can again rest flush with the housing 47, i.e with the seal 83 facing outward.

The bolt 87 locks the latch by preventing rotation of the stem 54 out of the latching position when tines 106 of the forked end embrace the opposed sides of the square section 86 of the stem part 57. The bolt 87 slides on guiding surfaces 107 molded into the interior of the housing 47 generally in a diametral direction along the line extending between the stem 54 and plug 76. The bolt 87 is moved by energization of the motor 92 when one or the other of the push buttons 37, 38 on the transmitter 17 is pressed. Rotation of the motor 92 and gears is converted to translation of the bolt 87 in its plane by interengagement of the gear 99 and rack 91.

The bolt 87 can also be selectively manually moved by turning a valid key 39 in the plug 76 to cause the lug 89 to pivot in one direction or the other about the axis of the plug in a known manner.

Figure 8:
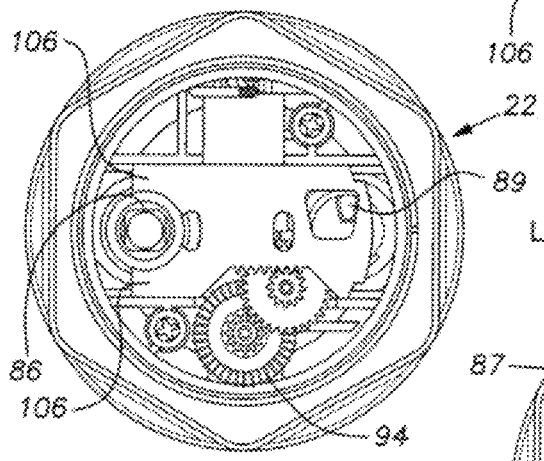
FIG. 8 is a view similar to FIG. 7 with the latch locked and a key neutral position.
Figure 10:
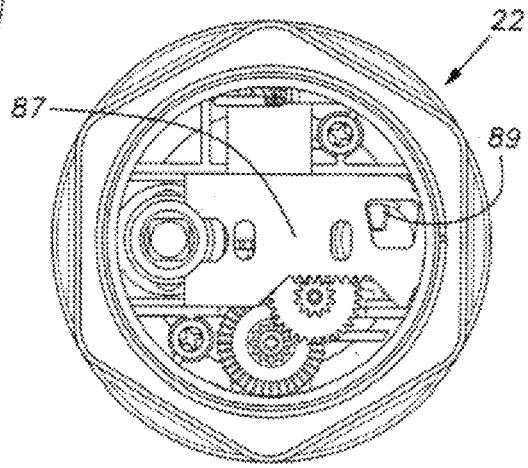
FIG. 10 is a view similar to FIG. 7 with the latch unlocked and a key neutral position.
Figure 11:
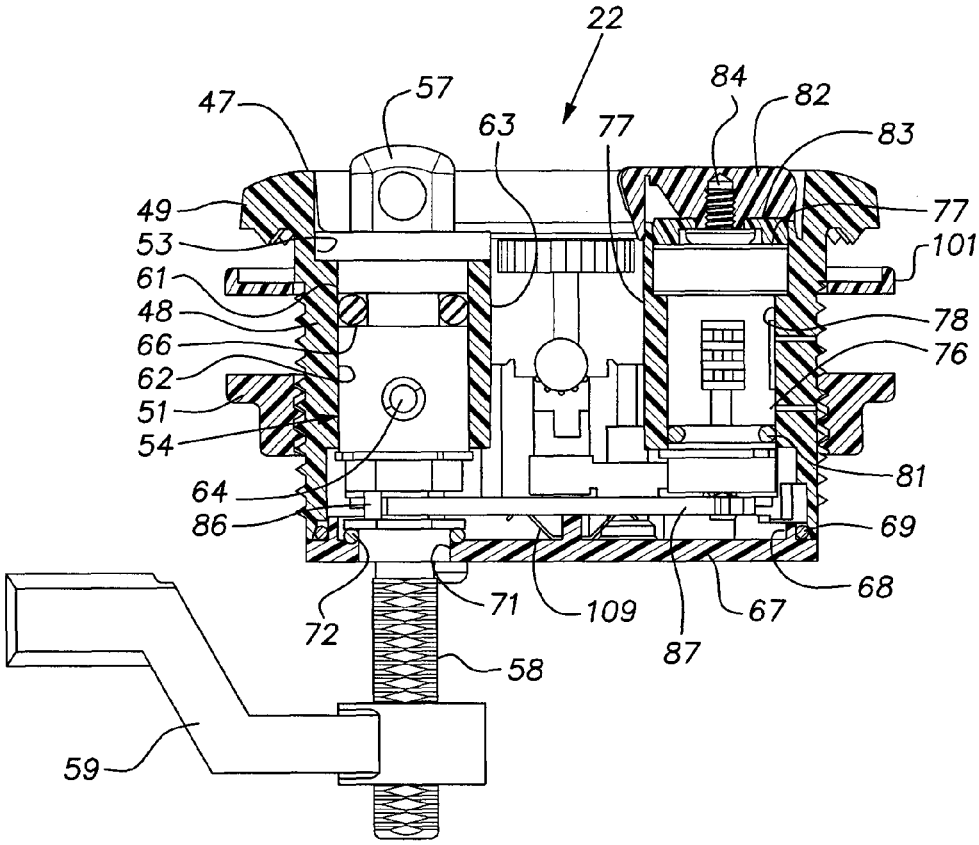
FIG. 11 is a somewhat schematic vertical sectional view of the lockable latch showing internal parts thereof.

FIGS. 7-10 illustrate different positions of the bolt 87 and/or operating lug 89. The lock plug 76 is of the commercially known type that requires the key to be in a neutral position for the key to be removed from the plug. FIGS. 8 and 10 illustrate the position of the lock lug 89 when the plug is in the neutral position. Friction and a detent leaf spring 109 squeezed between the bolt 87 and back cover 67 releasably retain the bolt in its locking or unlocking position. With the stem 54 in its latched position and the key in the neutral position, operation of the motor 92 will leave the bolt 87 either locked or unlocked depending on which transmitter button 37 or 38 was pushed and, consequently, the direction the motor 92 runs. At the end or limit of bolt motion, the motor 92 can momentarily stall until power is turned off.

It will be seen from FIGS. 7-10 that when the lock lug 89 is in a neutral position, there is sufficient clearance in the lug receiving opening 88 for the bolt 87 to be driven by the motor 92 to either its locked or unlocked position without interference from the lug. Moreover, since the gear train and motor 92 can be back driven by the lug 89 by manipulating the key 39, the bolt 87 can be locked or unlocked manually regardless of the position in which the bolt is left by the motor 92. Stated otherwise, the key 39 can be used to drive the lug 89 in one direction or the other to change the position previously obtained by the remotely controlled motor 92.

It will be seen that the joints and apertures between the housing proper 47 and cover 67 as well as the areas of these elements penetrated by the stem 54 and plug 76 are sealed with elastomeric O-rings to exclude water that may be splashed or dripped onto the latch assembly 22 thereby making the assembly splash proof.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A self-contained, remote controlled lockable marine latch comprising a hollow housing formed by walls, a pivotable catch stem, a bolt operable to prevent pivotable movement of the stem, and an electrically driven actuator all contained in the housing, the housing being arranged to exclude water and being substantially splash proof, the stem having a portion extending through a hole in a wall of the housing, a seal surrounding the stem portion extending through said hole to exclude water from entering the housing, the bolt in the housing being movable between a locked position and an unlocked position, the bolt in the locked position preventing the stem from pivoting out of a latched position and in the unlocked position, enabling the stem to move to an unlatched position, the bolt being driven by the actuator through a rack and pinion gear, a lock plug operable with a key, the lock plug having a lug disposed in a clearance hole in the bolt being arranged to override the position of the bolt determined by said actuator.

2. A lockable latch as set forth in claim 1, wherein said actuator is bi-directional.

3. A lockable latch as set forth in claim 2, wherein said actuator is a rotary electric motor.

4. A lockable latch as set forth in claim 3, wherein said rotary motor drives the rack through the pinion gear in two directions.

5. A lockable latch as set forth in claim 1, wherein said housing walls include a cylindrical skirt enabling the housing to be mounted in a circular hole in a panel.

6. A lockable latch as set forth in claim 5, wherein said cylindrical skirt is externally threaded and including a nut threadable onto said threaded skirt to effect mounting of said housing on a panel.

7. A lockable latch for marine use including a splash proof housing, a stem pivotally mounted on the housing, a latch carried on the stem externally of the housing, a handle external of the housing connected to the stem in a manner wherein the handle can be manipulated to pivot the stem and move the cam between a latching position and an unlatching position, a bolt within the housing movable between a lock position where it restrains pivoting of the stem, and an unlocked position wherein it permits pivoting of the stem, an electrically operated actuator in the housing for selectively moving the bolt between said lock and unlock positions, the bolt being driven by the actuator through a rack and pinion gear and a key operated lug disposed in a clearance hole in the bolt for manually moving said bolt between said lock and unlock positions independently of the position established by the actuator.

8. A lockable latch as set forth in claim 7, wherein said actuator is a rotary reversible electric DC motor.

9. A lockable latch as set forth in claim 8, wherein said motor is connected to said bolt through a gear train.

10. A lockable latch as set forth in claim 9, wherein said gear train is arranged to be back-driven by said lug.

11. A lockable latch as set forth in claim 10, wherein said gear train includes a pair of meshing bevel gears.

* * * * *